US011534372B2

(12) United States Patent
Xing et al.

(10) Patent No.: US 11,534,372 B2
(45) Date of Patent: Dec. 27, 2022

(54) FEEDING-BOTTLE COVER AND CONTROL METHOD THEREOF

(71) Applicant: BEIJING XIAOMI MOBILE SOFTWARE CO., LTD., Beijing (CN)

(72) Inventors: Zheng Xing, Beijing (CN); Yingchun Xie, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 237 days.

(21) Appl. No.: 16/792,140

(22) Filed: Feb. 14, 2020

(65) Prior Publication Data

US 2021/0093516 A1 Apr. 1, 2021

(30) Foreign Application Priority Data

Sep. 27, 2019 (CN) ..... 201910924493.0

(51) Int. Cl.
*A61J 11/00* (2006.01)
*A61J 9/08* (2006.01)

(52) U.S. Cl.
CPC ..... *A61J 11/003* (2013.01); *A61J 9/08* (2013.01); *A61J 11/005* (2013.01); *A61J 2200/42* (2013.01)

(58) Field of Classification Search
CPC .... A61J 11/003; A61J 2200/42; A61J 11/005; A61J 11/04
See application file for complete search history.

(56) References Cited

U.S. PATENT DOCUMENTS 6,109,100 A 8/2000 Buckley et al.
11,097,877 B2 * 8/2021 Griffis ..... B65D 51/28
2006/0081599 A1 * 4/2006 Anderson ..... A47J 36/2433 219/438

(Continued)

FOREIGN PATENT DOCUMENTS

EP 1885321 A2 2/2008
EP 3287117 A1 2/2018

(Continued)

OTHER PUBLICATIONS

Extended European search report of counterpart EP application No. 20159134.4 dated Feb. 8, 2021.

(Continued)

*Primary Examiner* — Don M Anderson
*Assistant Examiner* — Jennifer Castriotta
(74) *Attorney, Agent, or Firm* — Syncoda LLC; Feng Ma

(57) ABSTRACT

A feeding-bottle cover includes a feeding-bottle cover body shaped like a cake or sphere, a heating component, and a controlling component. A nipple portion is provided on an upper surface of the feeding-bottle cover body. A feeding-bottle port is provided on a lower surface of the feeding-bottle cover body. A channel is provided between the feeding-bottle port and the nipple portion. The heating component and the controlling component are disposed inside the feeding-bottle cover body and electrically connected to each other. The heating component and the controlling component are electrically coupled to each other and disposed inside the feeding-bottle cover, and the heating component can be controlled by the controlling component to heat the feeding-bottle cover body so as to simulate a body temperature.

18 Claims, 5 Drawing Sheets

(56) References Cited

U.S. PATENT DOCUMENTS

| | | | | |
|---|---|---|---|---|
| 2007/0014100 | A1* | 1/2007 | Perez | A61J 9/00 215/11.1 |
| 2013/0092649 | A1 | 4/2013 | Yi | |
| 2015/0335533 | A1 | 11/2015 | Pineda et al. | |
| 2016/0288983 | A1 | 10/2016 | Chin et al. | |
| 2018/0255966 | A1 | 9/2018 | Moore | |
| 2019/0008317 | A1 | 1/2019 | Alexander | |
| 2019/0231121 | A1 | 8/2019 | Alexander et al. | |

FOREIGN PATENT DOCUMENTS

| | | | |
|---|---|---|---|
| WO | 2006129302 | A2 | 12/2006 |
| WO | 2012174315 | A1 | 12/2012 |

OTHER PUBLICATIONS

Partial Extended European search report of counterpart EP application No. 20159134.4 dated Sep. 21, 2020.

* cited by examiner

FEEDING-BOTTLE COVER AND CONTROL METHOD THEREOF

CROSS-REFERENCE TO RELATED APPLICATION

The present application claims priority to Chinese Patent Application No. 201910924493.0 filed on Sep. 27, 2019, the disclosure of which is hereby incorporated by reference in its entirety.

BACKGROUND

A feeding bottle is a product that is supplied to an infant for holding milk. The infant drinks the milk in the feeding bottle by sucking a feeding-bottle cover that covers the front section of the feeding bottle. The feeding-bottle cover is usually made of a silica gel material.

SUMMARY

The present disclosure relates to the field of infant products, and more specifically to a feeding-bottle cover and a control method thereof.

According to an aspect of the present disclosure, there is provided a feeding-bottle cover, including a feeding-bottle cover body shaped like a cake or sphere, a heating component and a controlling component.

A nipple portion is formed on an upper surface of the feeding-bottle cover body. A feeding-bottle port is formed on a lower surface of the feeding-bottle cover body. A channel is formed between the feeding-bottle port and the nipple portion.

The heating component and the controlling component are disposed inside the feeding-bottle cover body and electrically connected to each other.

In some embodiments, the feeding-bottle cover further includes a scent volatilizing component disposed on the upper surface of the feeding-bottle cover body and electrically connected to the controlling component.

In some embodiments, a detachable port is formed between the nipple portion and the upper surface of the feeding-bottle cover body and includes a first port formed on the nipple portion and a second port formed on the upper surface of the feeding-bottle cover body. A storage groove is formed at the second port and configured to accommodate a liquid or a solid volatilized by the scent volatilizing component.

In some embodiments, one or a plurality of scent volatilizing holes is formed in the first port.

In some embodiments, a housing of the feeding-bottle cover body is made from a transparent or semi-transparent material. The feeding-bottle cover further includes a light-emitting component disposed inside the feeding-bottle cover body and electrically connected to the controlling component.

In some embodiments, a flowmeter sensor is disposed inside the channel and electrically connected to the controlling component.

In some embodiments, the feeding-bottle cover further includes a wireless communicating component disposed inside the feeding-bottle cover body and electrically connected to the controlling component.

In some embodiments, the channel is a flexible channel portion totally or in part. A pressurizing component that surrounds the flexible channel portion is further disposed inside the feeding-bottle cover body and electrically connected to the controlling component.

According to another aspect of the present disclosure, there is provided a feeding-bottle set, including a feeding-bottle cover and a feeding bottle. The feeding-bottle cover is the feeding-bottle cover described in the foregoing aspect.

According to yet another aspect of the present disclosure, there is provided a control method of a feeding-bottle cover. The method is applied to the feeding-bottle cover described in the foregoing aspect and includes: acquiring a control instruction by a controlling component; and controlling, based on the control instruction by the controlling component, a component in the feeding-bottle cover to execute a corresponding operation.

According to yet another aspect of the present disclosure, there is provided a mobile terminal, connected through a network to the wireless communicating component of the feeding-bottle cover described in the foregoing aspect. A control instruction is stored in the mobile terminal and configured to implement the control method of the feeding-bottle cover as described in the foregoing aspect.

According to yet another aspect of the present disclosure, there is provided a chip. A control instruction is stored in the chip and configured to implement the control method of the feeding-bottle cover as described in the foregoing aspect.

It is to be understood that the above general description and the detailed description below are merely exemplary and explanatory, and do not limit the present disclosure.

BRIEF DESCRIPTION OF THE DRAWINGS

The accompanying drawings, which are incorporated in and constitute a part of this disclosure, illustrate embodiments conforming to the present disclosure and, together with the specification, serve to explain the principles of the present disclosure.

Figure 1:
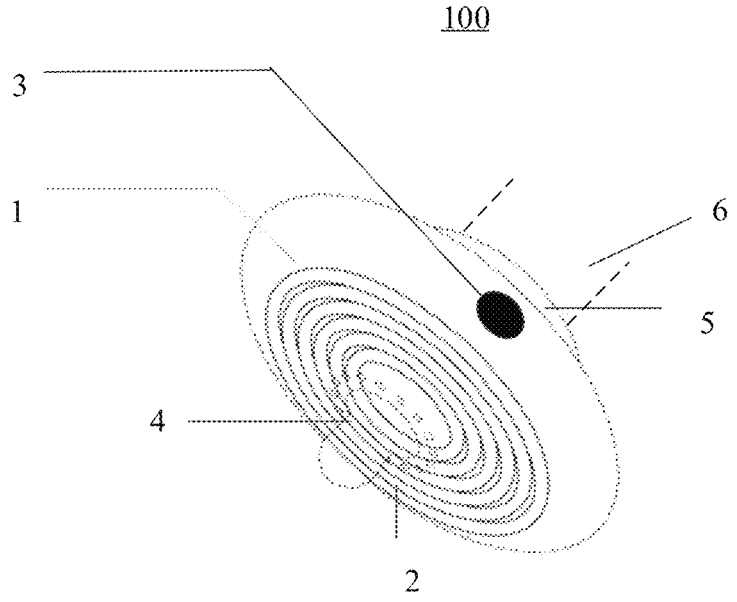
FIG. 1 is a schematic structural diagram of a feeding-bottle cover in accordance with some embodiments of the present disclosure.

Reference Numbers in the Drawings are Described as Below.

100: feeding-bottle cover;
1: feeding-bottle cover body;
2: heating component;
3: controlling component;
4: nipple portion;
5: feeding-bottle port;
6: channel;
7: scent volatilizing component;
71: scent volatilizing holes
8: port;
81: first port;
82: second port;
9: light-emitting component;
10: flowmeter sensor;
11: pressurizing component;
200: feeding bottle;
300: mobile terminal.

DETAILED DESCRIPTION

The present disclosure will be described in further detail with reference to the accompanying drawings, to present the objects, technical solutions, and advantages of the present disclosure more clearly.

Some breast-fed infants may be psychologically resistant to the feeding-bottle cover for their first contact. Because the silica gel material of the feeding-bottle cover is colorless, tasteless and temperature-free, those infants will not know whether it is edible food.

FIG. 1 is a schematic structural diagram of a feeding-bottle cover in accordance with some embodiments of the present disclosure. The feeding-bottle cover includes:

a feeding-bottle cover body 1 shaped like a cake or sphere, a heating component 2 and a controlling component 3.

A nipple portion 4 is formed on an upper surface of the feeding-bottle cover body 1. A feeding-bottle port 5 is formed on a lower surface of the feeding-bottle cover body 1. A channel 6 is formed between the feeding-bottle port 5 and the nipple portion 4.

The heating component 2 and the controlling component 3 are disposed inside the feeding-bottle cover body 1 and electrically connected to each other.

The feeding-bottle cover body 1 is a tool that is supplied for an infant to suck to obtain a liquid in a feeding bottle. The feeding-bottle cover body 1 simulates the shape of a human breast, and thus is shaped like a cake or sphere, including but not limited to: a round cake, an elliptical cake, a round sphere or an oblate sphere.

The heating component 2 is a component for heating the feeding-bottle cover body 1, such that a temperature of the feeding-bottle cover body 1 simulates a body temperature. In some embodiments, the heating component 2 is disposed at any position inside the feeding-bottle cover body 1.

Exemplarily, the heating component 2 heats the feeding-bottle cover body 1 up to 36° C.

The controlling component 3 is a component for controlling a function of a feeding-bottle cover 100.

In some embodiments, the controlling component 3 is elliptical. In some embodiments, there is one controlling component 3 by which the function of the feeding-bottle cover 100 is controlled. In some embodiments, the controlling component 3 is disposed at any position inside the feeding-bottle cover body 1.

In some embodiments, the heating component 2 is electrically connected to the controlling component 3, receives a control instruction from the controlling component 3 and executes a corresponding operation.

The nipple portion 4 is disposed on the upper surface of the feeding-bottle cover 100. The size of the nipple portion 4 allows the infant to open its mouth so as to fully suck the nipple portion 4. In some embodiments, the nipple portion 4 is made of but not limited to at least one of silica gel, latex and rubber. The nipple portion made of latex is characterized by its high security, nontoxicity, tastelessness and high transparency. The nipple portion made of silica gel is characterized by its resistance to temperature variations, boiling tolerance, smooth surface, transparency and tastelessness.

In some embodiments, a liquid outlet is formed in the top of the nipple portion 4 and is shaped like but not limited to at least one of a round hole, a cross shaped, or a "Y" shaped. The liquid outlet shaped like a round hole allows a liquid to automatically flow out at a low speed, and therefore, is suitable for newborns aged 0 to 3 months and still unable to control their milk suction. The cross-shaped liquid outlet can be opened and closed based on a suction force of the infant to adjust the feeding flow, and therefore, is suitable for drinking and sucking such coarse-granule drinks as juices and rice flour. The Y-shaped liquid outlet is relatively stable in milk flow, can be used for sucking nutritious rice flour or milk, and therefore, is suitable for the infants who are able to control their milk suction.

The feeding-bottle port 5 is disposed on the lower surface of the feeding-bottle cover 100. In some embodiments, the feeding-bottle port 5 is provided with an external thread or an internal thread.

The channel 6 is disposed between the feeding-bottle port 5 and the nipple portion 4. When the infant lies down and sucks the nipple portion 4 normally, the liquid enters the nipple portion 4 via the channel 6, and at last, enters the mouth of the infant.

As such, according to the method provided by the present embodiment, the heating component and the controlling component are electrically connected to each other and disposed inside the feeding-bottle cover, and the heating component can be controlled by the controlling component to heat the feeding-bottle cover body so as to simulate a body temperature. Thus, the function of the feeding-bottle cover is enriched. Meanwhile, the feeding-bottle cover body is shaped like a cake or sphere to simulate a breast, thus reducing inadaptation of the infant in contact with the feeding-bottle cover.

Figure 2:
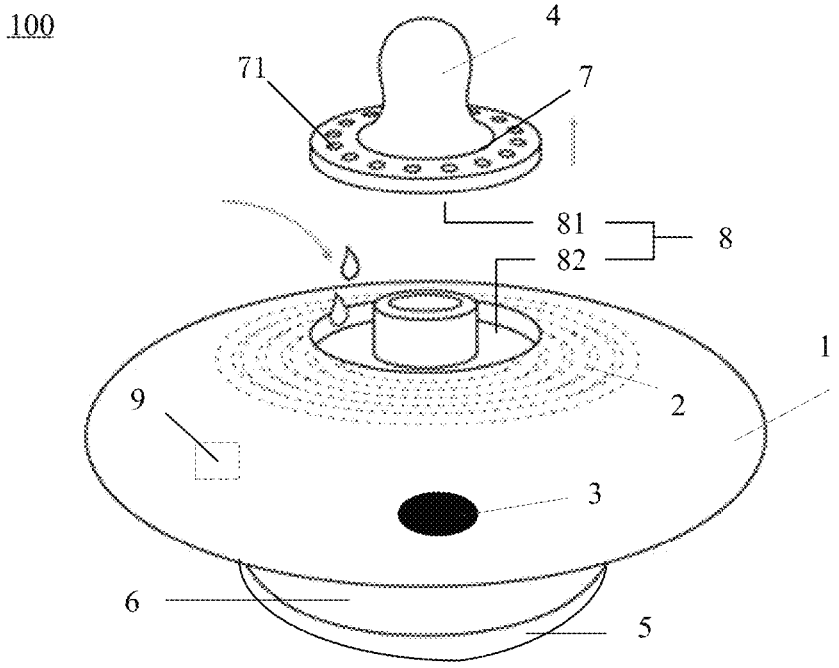
FIG. 2 is a schematic structural diagram of a feeding-bottle cover in accordance with some other embodiments of the present disclosure.

With reference to FIG. 2, in an optional embodiment based on FIG. 1, the feeding-bottle cover 100 further includes a scent volatilizing component 7 disposed on the upper surface of the feeding-bottle cover body 1 and electrically connected to the controlling component 3.

The scent volatilizing component is a component for volatilizing a scent. In some embodiments, the scent volatilized by the scent volatilizing component simulates a body scent. It is easy for the infant who sucks the nipple portion 4 and smells the scent to be familiar with the feeding-bottle cover 100. Then, the infant will not resist the feeding-bottle cover. Thus, the convenience in feeding is increased.

In some embodiments, the scent volatilizing component 7 is electrically connected to the controlling component 3, receives a control instruction from the controlling component 3 and executes a corresponding operation.

In one example, a port 8 is formed between the nipple portion 4 and the upper surface of the feeding-bottle cover body 1, the nipple portion 4 is detachably connected with the feeding-bottle cover body 1 via the port, and the port 8 includes a first port 81 formed on the nipple portion and a second port 82 formed on the upper surface of the feeding-bottle cover body 1. A storage groove is formed at the second port 82 and configured to accommodate liquids (e.g., mother's breast milk) or solids to be volatilized by the scent volatilizing component 7.

In some embodiments, the first port 81 and the second port 82 are secured by means of screwing. The securing mode of the first port 81 to the second port will not be limited by the present embodiment.

In one example, one or a plurality of scent volatilizing holes 71 are formed in the first port 81.

Figure 3:
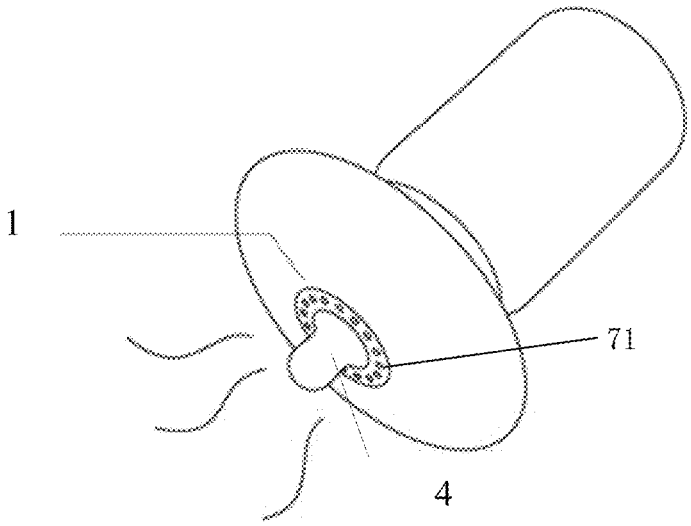
FIG. 3 is a schematic diagram showing that one or a plurality of scent volatilizing holes is formed in a first port in accordance with some embodiments of the present disclosure.

Exemplarily, as shown in FIG. 3, the liquids or the solids in the storage groove are volatilized by the scent volatilizing holes 71 to give off a scent.

As such, according to the feeding-bottle cover provided by the present embodiment, the scent volatilizing component can be controlled by the controlling component to volatilize the scent. The scent can simulate a body scent to help the infant adapt to the feeding-bottle cover. Thus, the function of the feeding-bottle cover is enriched.

With reference to FIG. 2, in one example, a housing of the feeding-bottle cover body 1 is made from a transparent or semi-transparent material. The feeding-bottle cover 100 further includes a light-emitting component 9 disposed in the feeding-bottle cover body 1 and electrically connected to the controlling component 3.

In some embodiments, the light-emitting component 9 has one or a plurality of emitting colors and emits light continuously or intermittently.

Excitation modes of the light-emitting component 9 include but are not limited to at least one of photoluminescence, cathode ray luminescence, radiation luminescence, electrode luminescence and injection electroluminescence.

In some embodiments, the light-emitting component 9 is electrically connected to the controlling component 3, receives the control instruction from the controlling component 3 and executes a corresponding operation.

Exemplarily, when the infant sucks the nipple portion 4, the light-emitting component 9 starts to emit light. The emitting color is changed once every 10 seconds.

As such, according to the feeding-bottle cover provided by the present embodiment, the light-emitting component can be controlled by the controlling component to emit light. The housing of the feeding-bottle cover body, which is made of the transparent or semi-transparent material, can transmit light to attract the attention of the infant and to help the infant to adapt to the feeding-bottle cover. Thus, the function of the feeding-bottle cover is enriched.

Figure 4:
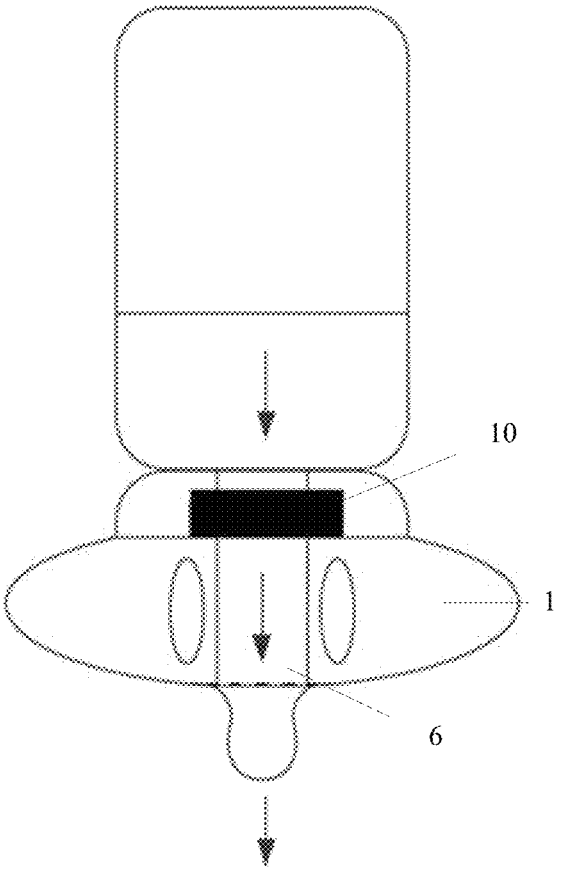
FIG. 4 is a schematic structural diagram of a feeding-bottle cover in accordance with yet some other embodiments of the present disclosure.

With reference to FIG. 4, in an optional embodiment based on FIG. 1, a flowmeter sensor 10 is disposed inside the channel 6 and electrically connected to the controlling component 3.

The flowmeter sensor 10 is a sensor for measuring the flow rate of the liquid flowing through the channel 6. The liquid includes but is not limited to at least one of such coarse-granule drinks as milk, water, juices and rice flour.

In some embodiments, the flowmeter sensor 10 senses the flow rate of the liquid and outputs a pulse signal or signals of current, voltage, etc. The output of the signals and the flow rate of the liquid are in a certain linear scale and have corresponding reduction formulas.

Figure 5:
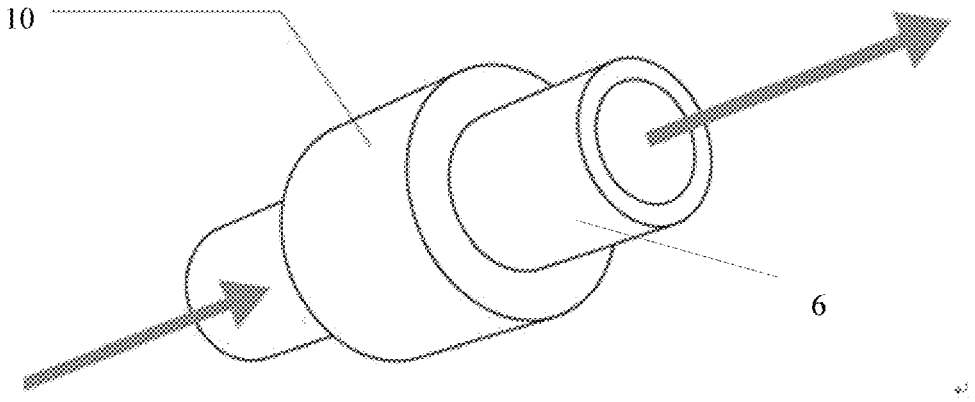
FIG. 5 is a schematic diagram of a flowmeter sensor in accordance with some embodiments of the present disclosure.

Exemplarily, as shown in FIG. 5, the flowmeter sensor 10 measures the flow rate of the liquid flowing through the channel 6.

In some embodiments, the flowmeter sensor 10 is electrically connected to the controlling component 3, receives the control instruction from the controlling component 3 and executes a corresponding operation.

As such, according to the feeding-bottle cover provided by the present embodiment, the flowmeter sensor is provided to monitor flow data of the liquid flowing through the feeding-bottle cover. Thus, milk drinking of the infant can be well known. Further, the function of the feeding-bottle cover is enriched.

Figure 6:
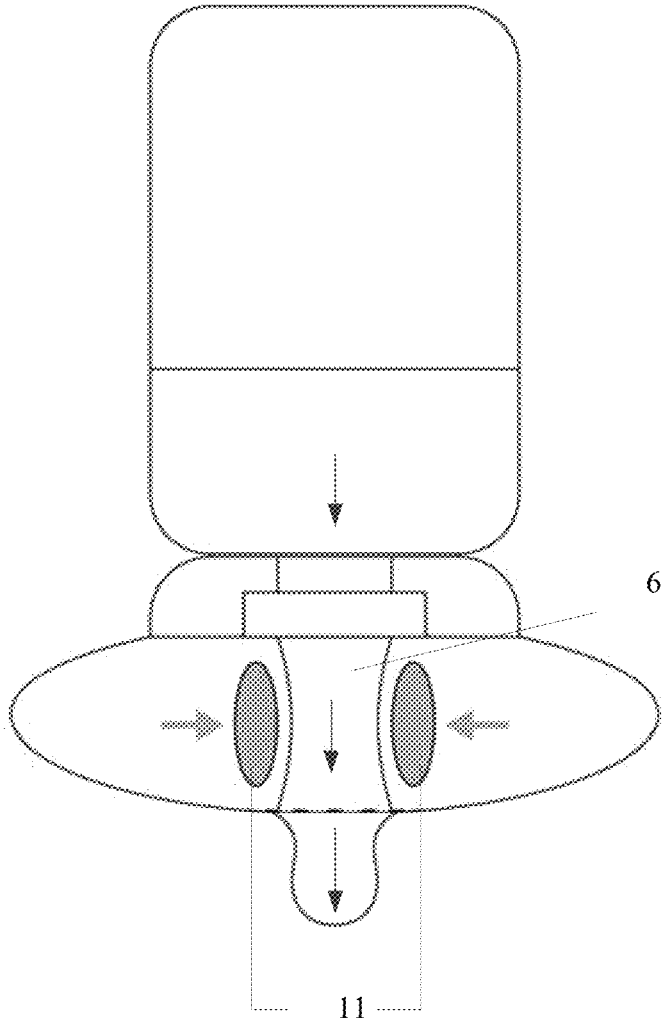
FIG. 6 is a schematic structural diagram of a feeding-bottle cover in accordance with yet some other embodiments of the present disclosure.

With reference to FIG. 6, in an optional embodiment based on FIG. 1, the channel 6 is a flexible channel portion totally or in part. A pressurizing component 11 that surrounds the flexible channel portion is further disposed inside the feeding-bottle cover body 1 and electrically connected to the controlling component 3.

The flexible channel portion means that the channel has certain flexibility. Thus, the flexible channel portion can be pressurized and elastically restored.

In some embodiments, the pressurizing component 11 is electrically connected to the controlling component 3, receives the control instruction from the controlling component 3 and pressurizes the flexible channel portion.

As shown in FIG. 6, the flexible channel portion pressurized by the pressurizing component 11 becomes narrow. Thus, the flow rate of the liquid flowing through the flexible channel portion will be reduced.

In one example, the feeding-bottle cover 100 further includes a wireless communicating component disposed inside the feeding-bottle cover body 1 and electrically connected to the controlling component 3.

As such, according to the method provided by the present embodiment, since the pressurizing component is provided, the flow rate of the liquid flowing through the channel can be controlled based on data of the flowmeter sensor. Thus, the infant may not choke due to suction of too much liquid at a time. Further, the use safety of the feeding-bottle cover is improved.

Figure 7:
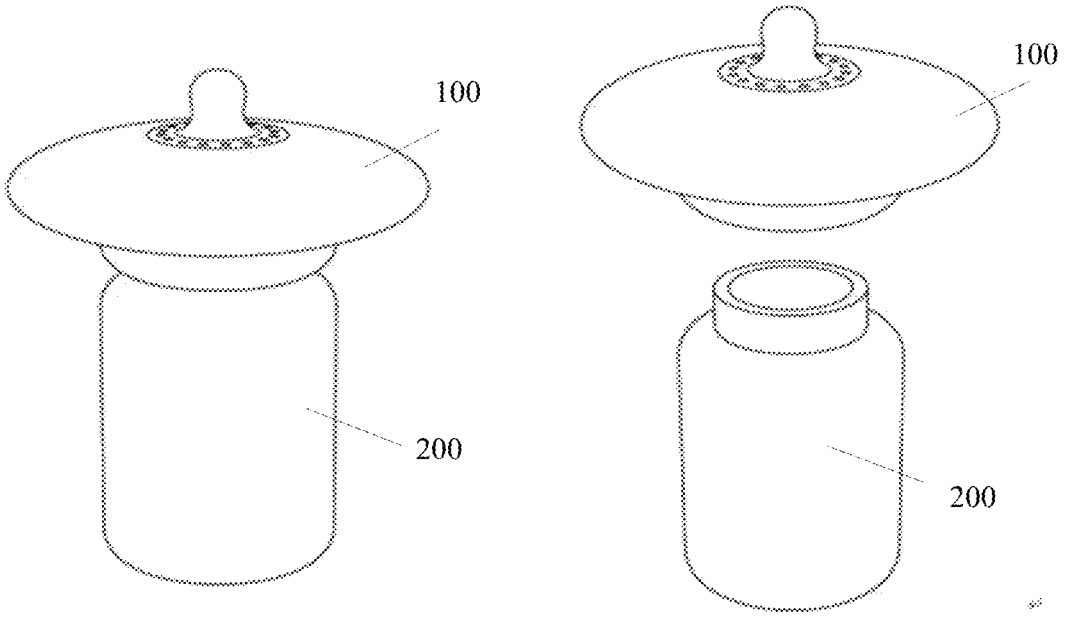
FIG. 7 is a schematic structural diagram of a feeding-bottle set in accordance with some embodiments of the present disclosure.

FIG. 7 is a schematic structural diagram of a feeding-bottle set in accordance with some embodiments of the present disclosure. The feeding-bottle set includes a feeding-bottle cover 100 and a feeding bottle 200. The feeding-bottle cover is any of the feeding-bottle covers 100 defined in the above-mentioned embodiments.

In some embodiments, the feeding-bottle cover 100 and the feeding bottle are secured to each other by means of screwing. Ports between the feeding-bottle cover 100 and the feeding bottle 200 match each other.

In some embodiments, a handle is disposed outside the feeding bottle 200.

Figure 8:
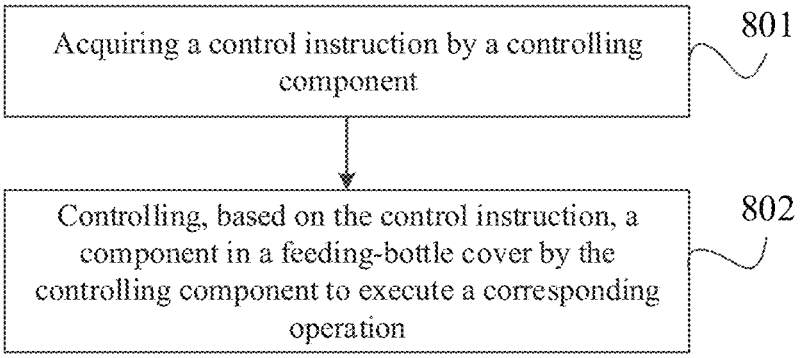
FIG. 8 is a flowchart of a control method of a feeding-bottle cover in accordance with some embodiments of the present disclosure.

FIG. 8 is a flowchart of a control method of a feeding-bottle cover in accordance with some embodiments of the present disclosure. The control method is applied to the feeding-bottle cover illustrated in the above-mentioned embodiments and includes the following steps.

In step 801, a controlling component acquires a control instruction.

In some embodiments, the control instruction includes but is not limited to at least one of a heating instruction, a light-emitting instruction, a pressurizing instruction, or a scent volatilizing instruction.

In step 802, the controlling component controls, based on the control instruction, a component in a feeding-bottle cover to execute a corresponding operation.

In some embodiments, the component in the feeding-bottle cover includes but is not limited to a heating component, a light-emitting component, a pressurizing component and a scent volatilizing component.

In one example, the control instruction includes a heating instruction. The feeding-bottle cover includes a heating component and a feeding-bottle cover body. That the controlling component controls, based on the control instruction, a component in a feeding-bottle cover to execute a corresponding operation includes: the controlling component controls, based on the heating instruction, the heating component to heat the feeding-bottle cover body.

In one example, the control instruction includes a pressurizing instruction. The feeding-bottle cover includes a pressurizing component and a feeding-bottle cover body. That the controlling component controls, based on the control instruction, a component in a feeding-bottle cover to execute a corresponding operation includes: the controlling component controls, based on the pressurizing instruction, the pressurizing component to pressurize a flexible channel portion in the feeding-bottle cover body.

In one example, the control instruction includes a light-emitting instruction. The feeding-bottle cover includes a light-emitting component. That the controlling component controls, based on the control instruction, a component in a feeding-bottle cover to execute a corresponding operation includes: the controlling component controls, based on the light-emitting instruction, the light-emitting component to emit light.

In one example, the control instruction includes a scent volatilizing instruction. The feeding-bottle cover includes a scent volatilizing component. That the controlling component controls, based on the control instruction, a component in a feeding-bottle cover to execute a corresponding operation includes: the controlling component controls, based on the scent volatilizing instruction, the scent volatilizing component to volatilize a scent.

In one example, the feeding-bottle cover further includes a wireless communicating component. That a controlling component acquires a control instruction includes: a controlling component receives a control instruction of a mobile terminal by the wireless communicating component, or a controlling component acquires an internally stored control instruction.

As such, according to the method provided by the present embodiment, the control instruction can be acquired by the controlling component and controls the component in the feeding-bottle cover to execute the corresponding operation. Thus, the function of the feeding-bottle cover is enriched.

Figure 9:
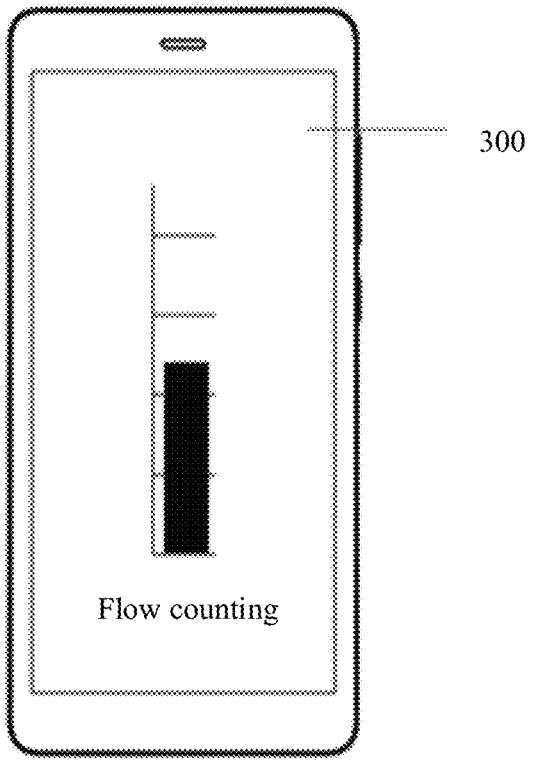
FIG. 9 is a block diagram of a mobile terminal in accordance with some embodiments of the present disclosure.

FIG. 9 is a block diagram of a mobile terminal 300 in accordance with some embodiments of the present disclosure. The mobile terminal 300 communicates, via a network, with the wireless communicating component of the feeding-bottle cover illustrated in the above-mentioned embodiments. A control instruction is stored in the mobile terminal and configured to implement the control method of the feeding-bottle cover, illustrated by the foregoing embodiments.

Exemplarily, a pressurizing instruction is stored in the mobile terminal 300 electrically connected to the wireless communicating component of the feeding-bottle cover. When water flows through a flowmeter sensor in the feeding-bottle cover, the flowmeter sensor records its flow rate and sends the record to the wireless communicating component. The wireless communicating component sends flow data to the mobile terminal. The mobile terminal displays the flow data in front of a user.

When the flow rate exceeds a preset threshold, the controlling component receives the pressurizing instruction of the mobile terminal by the wireless communicating component, and controls, based on the pressurizing instruction, the pressurizing component to pressurize the flexible channel portion in the feeding-bottle cover body. By pressurizing, the flexible channel portion is compressed to reduce the flow rate. Thus, the infant using the feeding-bottle cover may not choke due to suction of too much liquid at a time.

Figure 10:
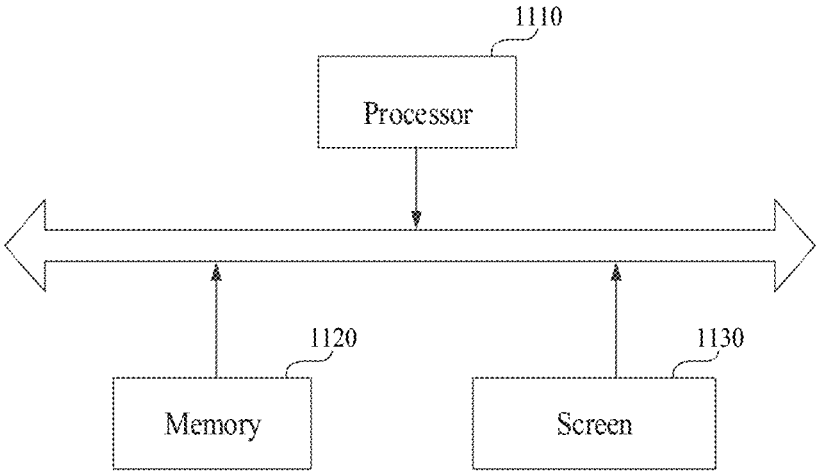
FIG. 10 is a schematic structural diagram of a mobile terminal in accordance with some other embodiments of the present disclosure.

Please refer to FIG. 10, which shows a structural block diagram of a mobile terminal provided by an exemplary embodiment of the present disclosure. The mobile terminal may be an electronic device, which is provided with and stores a control instruction, such as a smart phone, a tablet PC, an e-book or a portable personable computer. The mobile terminal in this disclosure may include one or more of the following components: a processor 1110, a memory 1120 and a screen 1130.

The processor 1110 may include one or more processing cores. The processor 1110 connects various portions within the entire terminal 1100 using various connectors and lines, and executes various functions of the terminal 1100 and processes data by running or executing an instruction, program, code set or instruction set stored in the memory 1120, and invoking data stored in the memory 1120. Alternatively, the processor 1110 may be implemented by using at least one of hardware forms of a Digital Signal Processor (DSP), a Field-Programmable Gate Array (FPGA), and a Programmable Logic Array (PLA). The processor 1110 may integrate one or a combination of two of a Central Processing Unit (CPU), a Graphics Processing Unit (GPU), a modem, and the like. The CPU mainly processes operating systems, user connectors, applications, etc.; the GPU is in charge of rendering and drawing a content required to be displayed by the screen 1130; and the modem is used to process wireless communication. It can be understood that the above modem may also not be integrated into the processor 1110 and is implemented by a single communication chip.

The memory 1120 may include a Random-Access Memory (RAM), and may also include a Read-Only Memory (ROM). Alternatively, the memory 1120 includes a non-transitory computer-readable storage medium. The memory 1120 may be used to store instructions, programs, codes, a code set, or an instruction set. The memory 1120 may include a memory program area and a memory data area, wherein the memory program area may store an instruction for implementing an operating system, an instruction for implementing at least one function (e.g., a touch function, an audio playback function and an image playback function), instructions for implementing the various method embodiments described above, and the like. The operating system may be an Android system (including a system based on Android system in-depth development), an IOS system (including a system based on IOS system in-depth development) developed by Apple Inc. or other systems. The storage data area may also store data (e.g., contacts, audio and video data and chat record data) created by the terminal 1100 in use, and the like.

The screen 1130 may be a touch display screen for receiving touch operations on or near the screen by a user using any suitable object, such as a finger and a touch pen, as well as displaying a user connector of each application. The touch display screen is usually disposed on a front panel of the mobile terminal. The touch display screen may be designed as a full screen, a curved screen or an anomalous screen. The touch display screen may also be designed as a combination of a full screen and a curved screen, or a combination of an anomalous screen and a curved screen, which is not limited by the embodiment of the present disclosure.

In addition, those skilled in the art can understand that the structure of the mobile terminal shown in the above figures does not constitute a limitation to the mobile terminal, and the terminal may include more or less components than those illustrated, or combine some components or adopt different component arrangements. For example, the mobile terminal also includes components such as a radio frequency circuit, a shooting component, a sensor, an audio circuit, a Wireless Fidelity (Wi-Fi) component, a power supply and a Bluetooth component, which will not be repeated herein.

An embodiment of the present disclosure further provides a chip with at least one control instruction stored therein. The at least one control instruction is used for implementing the control method of the feeding-bottle cover as illustrated by the above-mentioned embodiments.

Various embodiments of the present disclosure can have one or more of the following advantages.

The heating component and the controlling component are electrically connected to each other and disposed inside the feeding-bottle cover, and the heating component can be controlled by the controlling component to heat the feeding-bottle cover body so as to simulate a body temperature. Thus, the function of the feeding-bottle cover is enriched. Meanwhile, the feeding-bottle cover body is shaped like a cake or sphere to simulate a breast, thus reducing inadaptation of an infant in contact with the feeding-bottle cover.

Other implementation solutions of the present disclosure will be apparent to those skilled in the art from consideration of the specification and practice of the present disclosure. This disclosure is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. A feeding-bottle cover, comprising a breast-shaped feeding-bottle cover body, a heating component, and a controlling component, wherein a nipple portion is provided on an upper surface of the feeding-bottle cover body, a feeding-bottle port is provided on a lower surface of the feeding-bottle cover body, and a channel is provided between the feeding bottle port and the nipple portion; and the heating component and the controlling component are disposed inside the feeding-bottle cover body and electrically coupled to each other; and wherein the feeding-bottle cover further comprises a scent volatilizing component, wherein the scent volatilizing component is disposed on the upper surface of the feeding-bottle cover body and electrically connected to the controlling component.

2. The feeding-bottle cover according to claim 1, wherein a port is provided between the nipple portion and the upper surface of the feeding-bottle cover body;

the nipple portion is detachably connected with the feeding-bottle cover body via the port;

the port comprises a first port provided on the nipple portion and a second port provided on the upper surface of the feeding-bottle cover body; and a storage groove is provided at the second port and configured to accommodate liquids or solids to be volatilized by the scent volatilizing component.

3. The feeding-bottle cover according to claim 2, wherein one or a plurality of scent volatilizing holes are provided in the first port.

4. The feeding-bottle cover according to claim 1, wherein a housing of the feeding-bottle cover body is made of a transparent or semi-transparent material;

the feeding-bottle cover further comprises a light-emitting component; and the light-emitting component is disposed inside the feeding-bottle cover body and electrically connected to the controlling component.

5. The feeding-bottle cover according to claim 1, wherein a flowmeter sensor is disposed in the channel; and the flowmeter sensor is electrically connected to the controlling component.

6. The feeding-bottle cover according to claim 1, further comprising a wireless communicating component, wherein the wireless communicating component is disposed inside the feeding-bottle cover body and electrically connected to the controlling component.

7. The feeding-bottle cover according to claim 1, wherein the channel is a flexible channel portion totally or in part, and a pressurizing component that surrounds the flexible channel portion is further disposed inside the feeding-bottle cover body; and the pressurizing component is electrically connected to the controlling component.

8. A feeding-bottle set, comprising the feeding-bottle cover according to claim 1, and a feeding bottle.

9. A control method of a feeding-bottle cover, applied to the feeding-bottle cover according to claim 1, and comprising:

acquiring a control instruction by a controlling component; and controlling, by the controlling component, a component in the feeding-bottle cover to execute a corresponding operation based on the control instruction.

10. The method according to claim 9, wherein the control instruction comprises a heating instruction; and the controlling, by the controlling component, a component in the feeding-bottle cover to execute a corresponding operation based on the control instruction comprises:

controlling, by the controlling component, the heating component to heat the feeding-bottle cover body based on the heating instruction.

11. The method according to claim 9, wherein the controlling instruction comprises a light-emitting instruction and the feeding-bottle cover comprises a light-emitting component; and the controlling, by the controlling component, a component in the feeding-bottle cover to execute a corresponding operation based on the control instruction comprises:

controlling, by the controlling component, the light-emitting component to emit light based on the light-emitting instruction.

12. The method according to claim 9, wherein the control instruction comprises a pressurizing instruction and the feeding-bottle cover comprises a pressurizing component; and the controlling, by the controlling component, a component in the feeding-bottle cover to execute a corresponding operation based on the control instruction comprises:

controlling, by the controlling component, the pressurizing component to pressurize a flexible channel portion in the feeding-bottle cover body based on the pressurizing instruction.

13. The method according to claim 9, wherein the control instruction comprises a scent volatilizing instruction; the feeding-bottle cover comprises the scent volatilizing component; and the controlling, by the controlling component, a component in the feeding-bottle cover to execute a corresponding operation based on the control instruction comprises:

controlling, by the controlling component, the scent volatilizing component to volatilize a scent based on the scent volatilizing instruction.

14. The method according to claim 9, wherein the feeding-bottle cover further comprises a wireless communicating component, and the acquiring a control instruction by a controlling component comprises:

receiving, by the controlling component, a control instruction of a mobile terminal via the wireless communicating component, or acquiring an internally stored control instruction by the controlling component.

15. A mobile terminal implementing the method according to claim 9 with instructions stored thereon, wherein the mobile terminal is coupled to a wireless communicating component in the feeding-bottle cover through a network.

16. A chip having control instructions stored thereon and configured to implement the method according to claim 9.

17. The feeding-bottle cover according to claim 1, wherein the controlling component is configured to automatically control the heating component to heat the feeding-bottle cover simulating a body temperature.

18. The feeding-bottle cover according to claim 17, wherein the controlling component is configured to control the scent volatizing component to simulate a body scent through a mobile terminal application.

* * * * *